US008803741B2

(12) United States Patent
Lam

(10) Patent No.: US 8,803,741 B2
(45) Date of Patent: Aug. 12, 2014

(54) MINIATURE ANTI-JAM GPS ANTENNA ARRAY USING METAMATERIAL

(75) Inventor: Tommy Lam, Apalachin, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 221 days.

(21) Appl. No.: 13/407,973

(22) Filed: Feb. 29, 2012

(65) Prior Publication Data

US 2013/0222202 A1 Aug. 29, 2013

(51) Int. Cl.
*H01Q 1/38* (2006.01)

(52) U.S. Cl.
USPC ..... 343/700 MS; 343/756

(58) Field of Classification Search
USPC ..... 343/700 MS, 756, 909
See application file for complete search history.

(56) References Cited

U.S. PATENT DOCUMENTS

| | | | | |
|---|---|---|---|---|
| 4,772,890 | A * | 9/1988 | Bowen et al. | 343/700 MS |
| 5,125,992 | A | 6/1992 | Hubbard et al. | |
| 5,793,330 | A * | 8/1998 | Gans et al. | 343/700 MS |
| 6,938,325 | B2 | 9/2005 | Tanielian | |
| 7,797,817 | B2 | 9/2010 | Margomenos et al. | |
| 8,514,899 | B2 * | 8/2013 | Onose | 372/25 |
| 2004/0151876 | A1 | 8/2004 | Tanielian | |
| 2004/0252059 | A1 * | 12/2004 | Zaghloul et al. | 343/700 MS |
| 2007/0222683 | A1 * | 9/2007 | Duzdar et al. | 343/700 MS |
| 2011/0261441 | A1 * | 10/2011 | Zheludev et al. | 359/352 |

OTHER PUBLICATIONS

"Metamaterial," *Wikipedia*, pp. 1-15, http://en.wikipedia.org/wiki/Metamaterial, downloaded Feb. 28, 2012.
Office Action dated Oct. 7, 2013 for U.S. Appl. No. 13/403,328.
Shelby et al. "Experimental verification of a negative index of refraction" *Science* (2001) 292, p. 77-79.
Su et al. "Design and analysis of active frequency selective surfaces with organic semiconductor" 21st International Symposium on Space Terahertz Technology (2010) p. 360-363.

* cited by examiner

*Primary Examiner* — Hoanganh Le
(74) *Attorney, Agent, or Firm* — Wolf, Greenfield & Sacks, P.C.

(57) ABSTRACT

Antennae are described. The antennae may be GPS antennae configured to receive GPS signals at both the L1 and L2 frequencies. The antennae may include patches and polarizers which allow the antennae to receive right-hand circularly polarized GPS signals from GPS satellites. In some situations, the polarizers may include a meta-material. The metamaterial may in some situations include circuit components formed on a suitable substrate.

19 Claims, 12 Drawing Sheets

| Spiral Loop Design | | | | | | | |
|---|---|---|---|---|---|---|---|
| Turn | 6 | | | 4 | | 3 | |
| eps_r | 2.33 | | | 2.33 | | 2.33 | |
| | mm | mil | | mm | mil | mil | mil |
| lx | 3.19 | 125.6 | | 3.5 | 137.8 | 3.945 | 155.3 |
| lz | 3.19 | 125.6 | | 3.5 | 137.8 | 3.945 | 155.3 |
| s | 0.1 | 3.9 | | 0.1 | 3.9 | 0.1 | 3.9 |
| w | 0.1 | 3.9 | | 0.1 | 3.9 | 0.1 | 3.9 |
| dx | 3.828 | 150.7 | | 4.2 | 165.4 | 4.734 | 186.4 |
| dz | 3.828 | 150.7 | | 4.2 | 165.4 | 4.734 | 186.4 |
| dy | 1 | 39.4 | | 1 | 39.4 | 1 | 39.4 |
| ure1575 | -1.63 | | | -1.61 | | -1.61 | |
| uim1575 | -0.05 | | | -0.046 | | -0.041 | |

*Fig. 4*

MINIATURE ANTI-JAM GPS ANTENNA ARRAY USING METAMATERIAL

BACKGROUND

GPS satellites transmit GPS signals at two frequencies, referred to as the L1 and L2 frequencies. The L1 frequency is 1575.42 MHz. The L2 frequency is 1227.60 MHz. The GPS signals are right-hand circularly polarized.

GPS antennae are used to receive GPS signals. Because the received GPS signals are typically low-power, GPS antennae can be jammed by bombarding the antennae with interfering signals. A GPS antenna having N receiving elements can resist jamming signals propagating from N−1 locations.

BRIEF SUMMARY OF INVENTION

According to a first aspect, an antenna is provided, comprising a plurality of circular conductive patches, an electrical ground plane, and a plurality of meta-material elements. The plurality of meta-material elements and the plurality of circular conductive patches are paired together such that, for each circular conductive patch of the plurality of circular conductive patches, a respective meta-material element is disposed between the circular conductive patch and the electrical ground plane. At least one of the meta-material elements comprises a first plurality of substantially planar conductive loops and a second plurality of substantially planar conductive loops. Each substantially planar conductive loop of the first and second pluralities of substantially planar conductive loops is substantially perpendicular to the circular patch. Each substantially planar conductive loop of the first plurality of substantially planar conductive loops is substantially perpendicular to each substantially planar conductive loop of the second plurality of substantially planar conductive loops.

According to another aspect, an antenna is provided comprising a patch and a meta-material configured to be electromagnetically coupled to the patch. The meta-material may have an array of a first plurality of substantially planar conductive elements and a second plurality of substantially planar conductive elements, wherein a first substantially planar conductive element of the first plurality of substantially planar conductive elements and a second substantially planar conductive element of the second plurality of substantially planar conductive elements is oriented substantially perpendicularly to the patch. The first substantially planar conductive element is substantially perpendicular to the second substantially planar conductive element.

According to another aspect, a dual-band antenna is provided, comprising a first patch, a first polarizer, a second patch, and a second polarizer. Between an output of the antenna and an electrical ground plane of the antenna, the first patch, the first polarizer, the second patch, and the second polarizer are disposed in that order.

BRIEF DESCRIPTION OF DRAWINGS

FIG. 4 illustrates a table of values suitable for circuit components to be used in a polarizer comprising a meta-material, according to a non-limiting embodiment.

DETAILED DESCRIPTION

According to an aspect of the present application, an antenna suitable for use as a GPS antenna configured to receive signals at both the L1 and L2 frequencies is provided. The antenna may include patches and polarizers in combination, which may enable the antenna to receive right-hand circularly polarized GPS signals from GPS satellites. The patches may be circular patches in some non-limiting embodiments, and the polarizers may comprise a meta-material. Meta-materials are engineered materials that can exhibit a negative magnetic permeability. Magnetic permeability is often designated by "mu" (μ), and therefore meta-materials are sometimes referred to as mu negative (MNG, or μ negative) materials. According to an aspect of the present application, the meta-material may include suitable circuit components suitably oriented on substrates, which may be arranged relative to each other in a suitable manner to provide a desired electromagnetic behavior (e.g., a desired magnetic permeability). In some embodiments, a receiving element of the antenna may include two pairs of patches and polarizers disposed vertically with respect to each other. The antenna may include multiple receiving elements, which may facilitate resistance to jamming.

According to an aspect of the application, a dual band polarizer design is described. The dual band polarizer may be embedded as part of a meta-material of the types described herein.

The aspects described above, as well as additional aspects, are described further below. These aspects may be used individually, altogether, or in any combination of two or more, as the technology is not limited in this respect unless otherwise stated.

Figure 1:
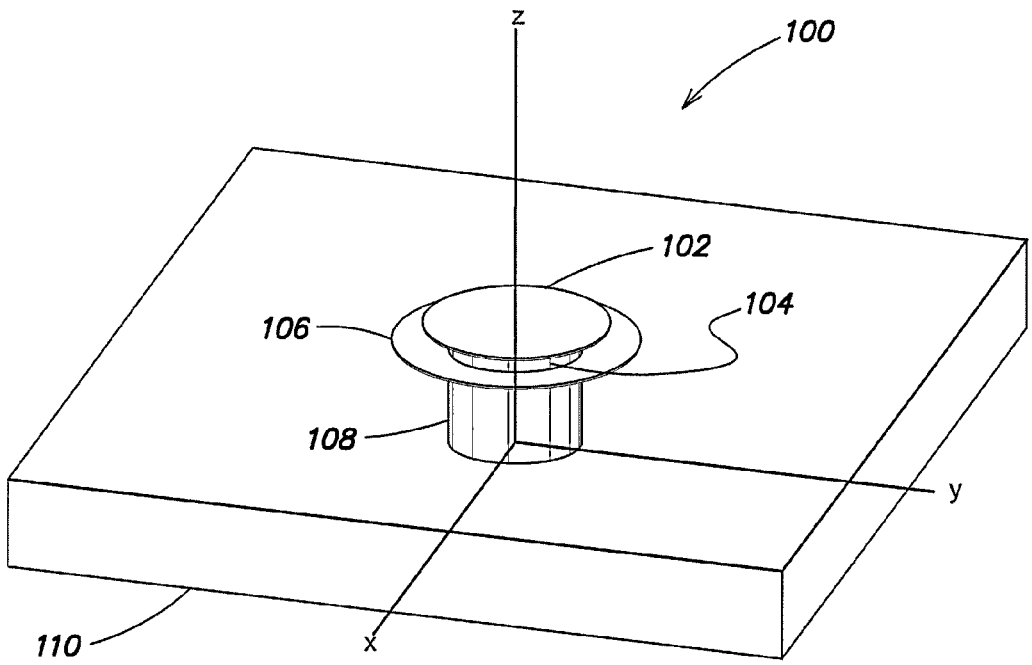
FIG. 1 illustrates a receiving element of an antenna including two patches and two polarizers, according to a non-limiting embodiment.

FIG. 1 illustrates a non-limiting example of an antenna element 100 including multiple patches and polarizers, according to an aspect of the present application. As shown, the antenna element 100 includes a first patch 102, a first polarizer 104, a second patch 106, and a second polarizer 108. The patches may function as the radiating and/or receiving components of the antenna element 100, and therefore may also be referred to herein as "radiators" and "receivers." The antenna element 100 may further include a ground plane 110, which in some non-limiting examples may be shared among multiple antenna elements, as will be described further below in connection with FIG. 10.

The antenna element 100 may be configured to operate as a dual-band antenna element, capable of receiving signals at multiple (e.g., two) frequencies. For example, the first patch 102 and first polarizer 104 may operate in combination to receive signals at a first frequency, for example, at the L1 frequency. The patch 106 and polarizer 108 may operate in combination to receive signals at a second frequency, for example at the L2 frequency. Other frequencies of operation are also possible, as the L1 and L2 frequencies are non-limiting examples.

The patch 102 and polarizer 104 may each be of any suitable type, and may further be of any suitable relevant orientation, to provide suitable reception of signals at a desired first resonant frequency, such as the L1 frequency. In the non-limiting example illustrated, patch 102 is a circular patch, although alternative geometries are possible. The patch 102 may be formed of any suitable material, such as copper or other suitable conducting materials. The patch 102 may have any suitable dimensions (e.g., diameter in those embodiments in which the patch is circular), and in some embodiments may have a larger surface area that that of the polarizer 104. For example, the patch 102 may be circular, and its diameter may be larger than the surface dimensions of the polarizer 104. As a non-limiting example, the diameter of patch 102 may be in the range from approximately one-half inch to approximately three inches, from approximately one-half inch to approximately two inches, may be approximately one inch, approximately 1.5 inches, or may have any other suitable value.

The polarizer 104 may be formed of any suitable material. As a non-limiting example, the polarizer 104 may comprise a meta-material, and therefore may exhibit a negative magnetic permeability. The meta-material may be configured to allow reception by the antenna element 100 of circularly polarized signals, such as GPS signals. The patch 102 may be linearly polarized, as thus the polarizer 104 may have any suitable configuration to account for the linearly polarized nature of the patch 102 while providing for reception of right-hand circularly polarized signals as may be transmitted by GPS satellites. A non-limiting example of a suitable meta-material is illustrated and described below with respect to FIG. 2.

The polarizer 104 may have any suitable dimensions, and in some embodiments may be smaller than the patch 102. For example, in some embodiments the polarizer may be circular in cross-section and have a diameter equal to or less than approximately 80% of the diameter of the patch 102, less than approximately 70% of the diameter of the patch 102, approximately 50% of the diameter of the patch 102, or any other suitable value. For example, the polarizer 104 may have a diameter between approximately one-half inch and one inch. The diameter may be approximately 0.75 inch, approximately 0.8 inch, or any other suitable value. The polarizer 104 may also have any suitable height, for example, less than one-half inch, less than one inch, approximately 0.1 inch, approximately 0.2 inch, or any other suitable height.

As mentioned, the patch 102 and polarizer 104 may be physical separated by any suitable distance to provide reception of signals of a desired frequency. The distance of separate may be between approximately 0.1 inches and approximately three inches, between approximately one inch and approximately four inches, or may take any other suitable value.

As with the patch 102, the patch 106 may have any suitable shape, dimensions, and may be formed of any suitable material. As a non-limiting example, the patch 106 may be a circular patch, and may be formed of copper. Other materials and shapes are also possible. In some embodiments, the patch 106 may have a larger diameter than the patch 102, for example, such that the patch 106 may be configured to have a different resonant frequency than the patch 102. In some non-limiting examples, the patch 106 and the polarizer 108 may be configured in combination to receive signals at the L2 frequency, though other frequencies are possible.

The polarizer 108 may be similar in some respects to the polarizer 104, previously described. For example, in some non-limiting embodiments, the polarizer 108 may comprise a meta-material, a suitable example of which is described below with respect to FIG. 2. The polarizer 108 may have any suitable dimensions. In a non-limiting embodiment, the polarizer 108 may have a circular cross-section with a smaller diameter than the diameter of patch 106. As a non-limiting example, the polarizer 108 may have a diameter less than approximately 80% of the diameter of the patch 106, less than approximately 70% of the diameter of the patch 106, approximately 50% of the diameter of the patch 106, or any other suitable value. As a non-limiting example, the polarizer 108 may have a diameter less than approximately one-half inch, less than approximately one inch, equal to approximately one inch, or any other suitable value. The polarizer 108 may also have any suitable height, as the various aspects described herein are not limited in this respect.

As mentioned, a ground plane 110 may be provided to provide an electrical ground. The ground plane 110 may be formed of any suitable material, a non-limiting example of which is aluminum. Other materials are also possible. The ground plane may have any suitable dimensions, and as mentioned previously, in some embodiments may be large enough to be shared amongst multiple antenna elements. The patches 102 and 106 and polarizer 104 and 108 may be arranged at any suitable distance from the ground plane 110. Thus, the positioning with respect to the ground plane is non-limiting, unless otherwise stated.

As will be described further below in connection with FIG. 10, according to an embodiment of the present application, the patches 102 and 106 may be contacted (and accessed) via a single electrical port. Such a configuration may simplify the electronics and operation of the antenna element 100.

As illustrated, according to a non-limiting embodiment, the patches 102 and 106 and the polarizers 104 and 108 may be configured substantially aligned with each other, e.g., along a single line. For example, the patches and polarizers may be aligned along an anticipated transmission/reception path of the antenna element. In the non-limiting embodiment illustrated, the patches and polarizers may be substantially cylindrical bodies, and the centerlines of each cylindrical body may be aligned. However, other configurations are possible.

It should be appreciated that FIG. 1 illustrates a non-limiting example of a dual-band antenna element. As previously mentioned, for example, the patch 102 and polarizer 104 may be configured to have a first resonance frequency, and to receive and/or transmit signals at the first resonance frequency. For example, the first resonance frequency may be the GPS L1 frequency, although other frequencies are possible. Likewise, the patch 106 and polarizer 108 may be configured to exhibit a second resonance frequency, and to receive and transmit signals at the second resonance frequency. For example, the second resonance frequency may be the GPS L2 frequency, although alternative frequencies are possible. In this manner, the antenna element 100 may be suitable for use as a dual-band GPS antenna, receiving signals at both the L1 and L2 frequencies. Not all embodiments are limited in this manner, as various aspects of the present application may apply to antennae which are not GPS antennae and/or which are not dual-band antennae.

Figure 2:
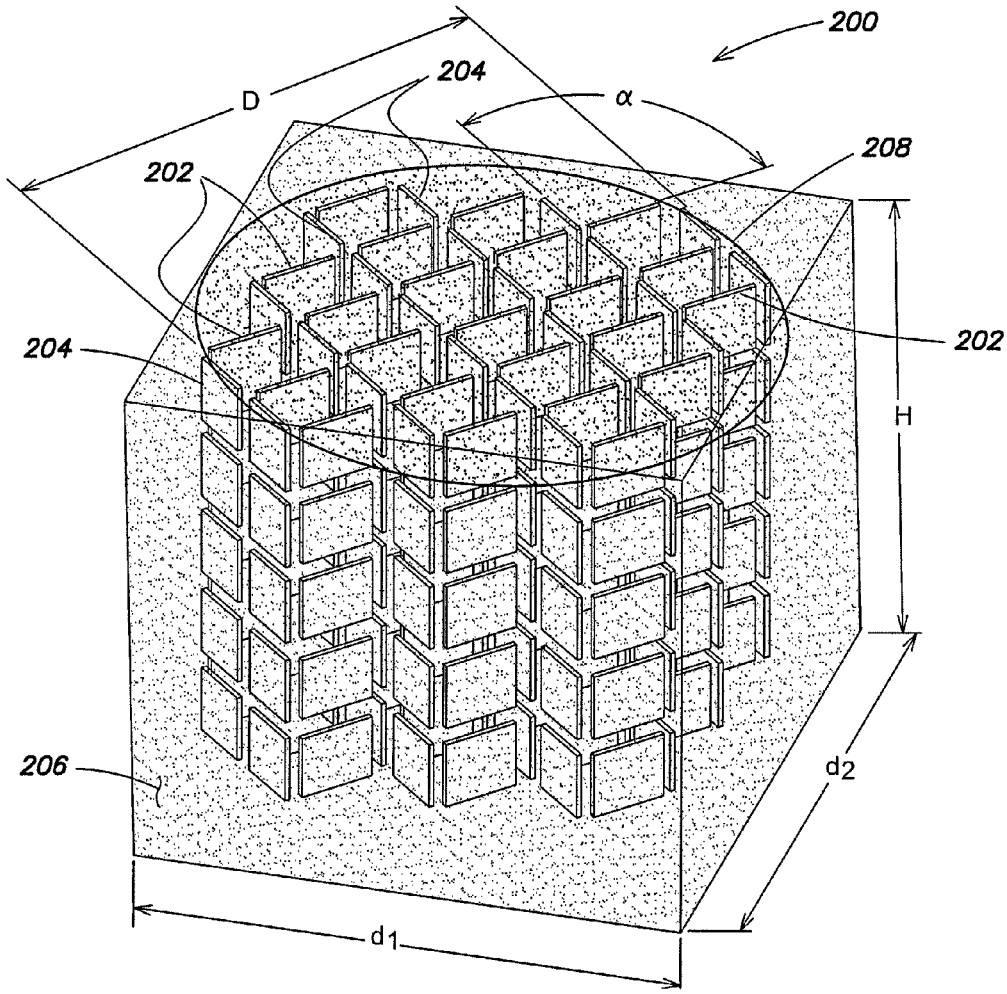
FIG. 2 illustrates a polarizer comprising a meta-material as may be used in an antenna element of the type illustrated in FIG. 1, according to a non-limiting embodiment.

FIG. 2 illustrates a non-limiting example of a polarizer comprising a meta-material, as may be used for polarizers 104 and 108 of FIG. 1, or in any other aspects of the present application. As shown, the meta-material 200 may include a plurality of segments 202 and 204. The segments 202 may be arranged in rows and columns of similarly oriented segments. Likewise, the segments 204 may be arranged in rows and columns of similarly oriented segments. As illustrated, the segments 202 and 204 may be oriented at an angle $\alpha$ with respect to each other. The angle $\alpha$ may be any suitable angle, such as a right angle (90°) or any other suitable angle.

In some embodiments, the segments 202 and 204 may be connected, for example, being part of the same corrugated strip of material. A non-limiting example is illustrated and described further below in connection with FIG. 6. Alternatively, as shown in FIG. 2, each of the segments 202 and 204 may be physically distinct from the other segments of the polarizer 200. In such an embodiment, the segments 202 and 204 may be held in place relative to each other in any suitable manner. For example, the segments 202 and 204 may be disposed within an optional material 206. For example, the material 206 may be a filler material, configured to fill gaps between the segments 202 and 204 in such a manner that the segments may be maintained in a relatively fixed position. A non-limiting example of a suitable material 206 is a foam material, such as a syntactic foam, an example of which is further illustrated in FIG. 7, described below. Other materials may alternatively be used.

Each of the segments 202 and 204 may include a circuit component formed thereon. For example, each of the segments may include a substrate on which an electrical trace is formed. Non-limiting examples of circuit components include split-ring resonators and spiral loops. Examples are illustrated and described below in connection with FIGS. 3A-3F. Briefly, however, the circuit components may be configured to operate as individual antennae, and collectively to cause the polarizer 200 to operate as a suitable polarizer for allowing an antenna element including the polarizer to receive a right-hand circularly polarized signal (e.g., a GPS signal) via a linearly polarized circular patch, such as patch 208. Patch 208 may be substantially the same as patches 102 and 106 of FIG. 1.

Figure 3A:
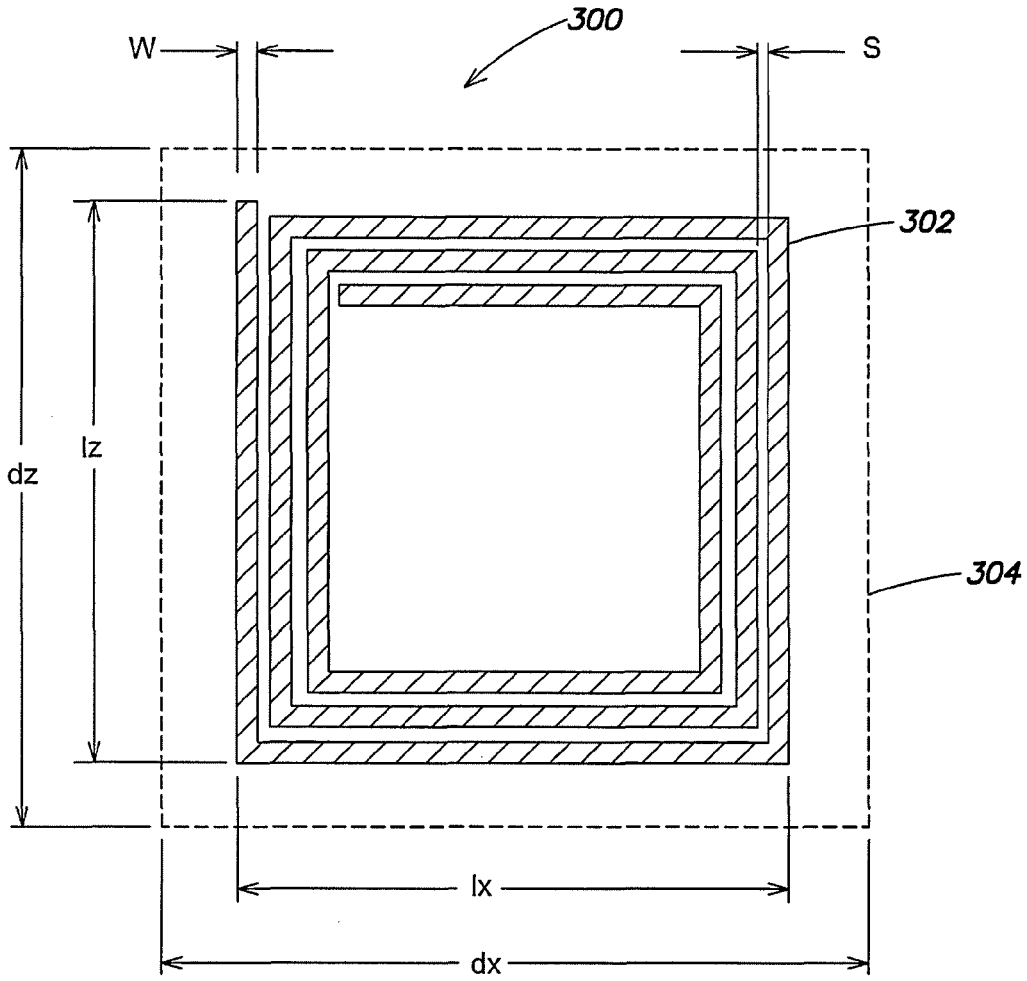
FIGS. 3A-3F illustrate non-limiting examples of a circuit component of a type suitable for use in a polarizer of the type illustrated in FIG. 2.

As mentioned, each of segments 202 and 204 may include a circuit component formed thereon. Suitable examples of circuit components are illustrated in FIGS. 3A-3F, though it should be appreciated that alternatives are possible. Referring to FIG. 3A, a spiral loop 300 (e.g., a conductive trace formed in a spiral) is illustrated, which represents a non-limiting example of a suitable circuit component of the type that may be used for segments 202 and/or 204 in the polarizer 200 of FIG. 2. The spiral loop 300 may include a trace 302 configured as shown on a substrate 304. The trace may be a copper trace, or formed of any other suitable conducting material, and may be formed in any suitable manner. According to a non-limiting embodiment, the substrate 304 may be a printed circuit board, though alternatives are possible. In some embodiments, the substrate 304 may be a flexible material, such that the circuit component 300 may be capable of flexing.

The spiral loop of FIG. 3A may be characterized by the number of turns, the dielectric constant of the substrate 304, and the thickness of the trace, W, the thickness of the gap between turns of the trace, S, and the dimensions $l_z$, $l_x$, $d_x$, and $d_z$. Those dimensions illustrated in FIG. 3A may take any suitable values, as the various embodiments employing such circuit components are not limited in this respect. According to some embodiments, the illustrated circuit component 300 may be configured to exhibit a desired resonance frequency, as will be described further below. Accordingly, the number of loops illustrated, the thickness of the trace, W, the thickness of the gap between turns of the trace, S, and the dimensions $l_z$, $l_x$, $d_x$, and $d_z$ may take any suitable values. As a non-limiting example, the values of $d_x$ and $d_z$ may both be approximately one-quarter inch, with the values of $l_x$, and $l_z$ being slightly smaller (e.g., approximately one-fifth inch as a non-limiting example). Non-limiting examples of suitable values for the illustrated dimensions are provided in the table of FIG. 4. In FIG. 4, "eps_r" represents the dielectric constant of the substrate material. "ure 1575" represents the real part of the mu ($\mu$) value at 1.575 GHz L1 GPS frequency, while "uim 1575" represents the imaginary part of the mu ($\mu$) value at 1.575 GHz L1 GPS frequency. It should be appreciated that these are non-limiting examples, that other values are possible.

FIGS. 3B-3F illustrate non-limiting alternatives to the circuit component 300 of FIG. 3A. In the non-limiting example of FIG. 3B, a split ring resonator 306 is illustrated. As shown, the split ring resonator 306 may include a substantially square trace (e.g., a copper trace, a copper wire, or any other suitable conductive structure), with a single split 308 between two ends of the trace. The split ring resonator may have any suitable dimension $D_1$.

Figure 3D:
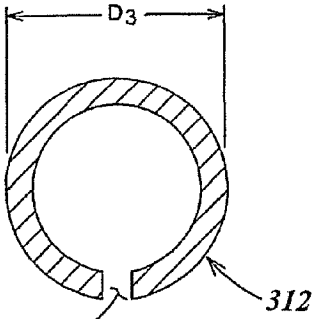
Figure 3C:
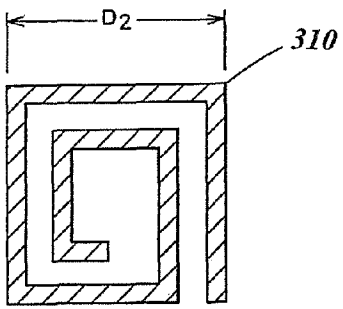
Figure 3B:
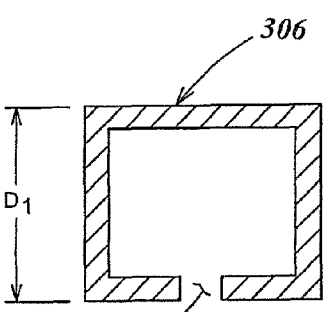

FIG. 3C illustrates an alternative circuit component design, showing a spiral loop 310. The spiral loop may have any suitable diameter $D_2$ and be formed of any suitable material (e.g., a copper trace or wire, aluminum, are any other suitable material).

A further non-limiting embodiment is illustrated in FIG. 3D, showing a substantially circular loop 312 having a split 314 between two end. The loop 312 may have any suitable diameter $D_3$ and be formed of any suitable material.

Figure 3F:
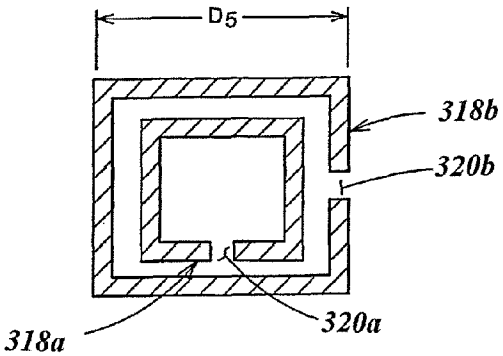
Figure 3E:
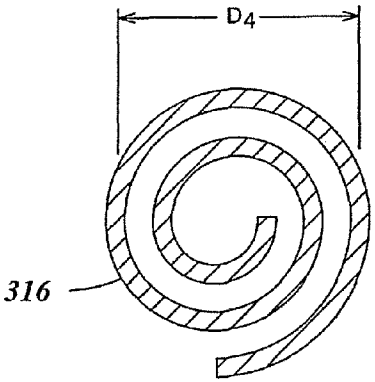

FIG. 3E illustrates a further non-limiting embodiment, illustrating a spiral loop 316 with a diameter $D_4$.

In some embodiments, the circuit component may include multiple disconnected loops or rings. For example, FIG. 3F illustrates a non-limiting example in which two substantially square rings 318*a* and 318*b* are shown. The outer ring 318*b* may have any suitable length $D_5$. Respective slits 320*a* and 320*b* may be formed in each loop, as shown, and the respective slits may be offset from each other. Other configurations are also possible.

In any of FIGS. 3B-3F, the illustrated structures may be formed of any suitable material (e.g., any suitable conducting material, such as copper, aluminum or any other suitable material).

Also, any suitable values for the dimensions of the structures in FIGS. 3B-3F may be used. In some embodiments, the dimensions of the illustrated structures may be chosen to provide desired electromagnetic behavior. For example, the dimensions may control a resonance frequency of the illustrated structures, and thus may be selected to provide a desired resonance frequency. As a non-limiting example, the dimension $D_1$ may control the resonance frequency of the loop 306 in FIG. 3B. Thus, the value of $D_1$ may be selected such that the loop 306 has a desired resonance frequency. However, not all embodiments are limited in this respect.

As non-limiting examples, the values of $D_1$-$D_5$ may be between approximately 0.1 inches and approximately 2 inches (e.g., ¼ inch, ½ inch, ¾ inch, etc.), between approximately one inch and four inches (e.g., two inches, three inches, etc.), may be between approximately one inch and two inches, may be less than approximately four inches, less than approximately two inches (e.g., 0.25 inches, 0.5 inches, one inch, etc.), or may have any other suitable values.

As mentioned with respect to FIG. 2, the segments 202 and 204 may include circuit components thereon, such as any of those illustrated in FIGS. 3A-3F, or any other suitable circuit component, which may collectively cause the polarizer 200 to act as a polarizer. According to a non-limiting embodiment, desired polarizer functionality may be achieved by utilizing circuit components on segments 202 that differ from circuit components on segments 204. In a non-limiting embodiment, the segments 202 may include circuit components having a resonance frequency less than a resonance frequency of an antenna element including the polarizer 200. As a non-limiting example, assume that the polarizer 200 forms part of the antenna element configured to operate on GPS signals at the L1 frequency. In such a scenario, the segments 202 may include circuit components thereon (e.g., any of the circuit components illustrated in FIGS. 3A-3F) having a resonance frequency less than the L1 frequency. For example, the circuit components of segments 202 may have a resonance frequency that is approximately 2% less than the desired resonance frequency of the antenna element, that is approximately 5% less than the desired resonance frequency of the antenna element, that is approximately 10% less than the desired resonance frequency of the antenna element, that is less than the desired resonance frequency of the antenna element by approximately by between approximately 1% and 10%, or any other suitable value.

By contrast, segments 204 may include circuit components formed thereon exhibiting a resonance frequency greater than a desired resonance frequency of an antenna element including the polarizer 200. For example, again, assuming that the polarizer 200 forms part of an antenna element configured to operate on GPS signals at the L1 frequency, segments 204 may include circuit components formed thereon having a resonance frequency greater than the L1 frequency. For example, circuit components on segments 204 may exhibit a resonance frequency that is approximately 2% greater than the desired resonance frequency of the antenna element, approximately 5% greater than the desired resonance frequency of the antenna element, approximately 10% greater than the desired resonance frequency of the antenna element, between approximately 2% and 10% greater than the desired resonance frequency of the antenna element, or may have any other suitable value. In summary, then, segments 202 and 204 may include circuit components formed thereon which exhibit resonance frequencies below and above, respectively, a desired resonance frequency for an antenna element including the polarizer 200.

According to a non-limiting embodiment, a polarizer of the type illustrated by polarizer 200 may form part of an antenna element configured to operate on GPS signals at the L1 frequency, e.g., polarizer 104 of FIG. 1. Segments 202 may include spiral loops formed thereon exhibiting a resonance frequency of approximately 2% below the L1 frequency, and segments 204 may include spiral loops formed thereon exhibiting a resonance frequency approximately 2% greater than the L1 frequency. In this non-limiting embodiment, segments 202 and 204 may be oriented at a right angle with respect to each other, such that segments 202 may be considered to be −45° segments, while segments 204 may be considered to be +45° segments.

According to such an embodiment, a polarizer of the type illustrated by polarizer 200 may further form part of an antenna element configured to operate on GPS signals at the L2 frequency, e.g., polarizer 108 of FIG. 1. For such a polarizer, segments 202 may include spiral loops formed thereon exhibiting a resonance frequency of approximately 2% below the L2 frequency, and segments 204 may include spiral loops formed thereon exhibiting a resonance frequency approximately 2% greater than the L2 frequency. In this non-limiting embodiment, segments 202 and 204 may be oriented at a right angle with respect to each other, such that segments 202 may be considered to be −45° segments, while segments 204 may be considered to be +45° segments. Thus, a dual-band antenna element may be formed in the manner described.

The polarizer 200 may include any suitable dimensions, $d_1$, $d_2$, and H. Accordingly, it should be appreciated that any suitable number of segments 202 and 204 may be provided, and they may be arranged in any suitable number of rows and columns. Thus, the configuration illustrated in FIG. 2 is a non-limiting example.

Referring again to FIG. 2, the outline of a patch 208 is superimposed on top of the polarizer 200 to provide an indication of the relative dimensions according to a non-limiting embodiment. As described above with respect to FIG. 1, in some embodiments a patch may be larger than an underlying polarizer. As illustrated in FIG. 2, the diameter D of patch 208 may be larger than the space covered by segments 202 and 204. However, not all embodiments are limited in this respect.

Figure 5:
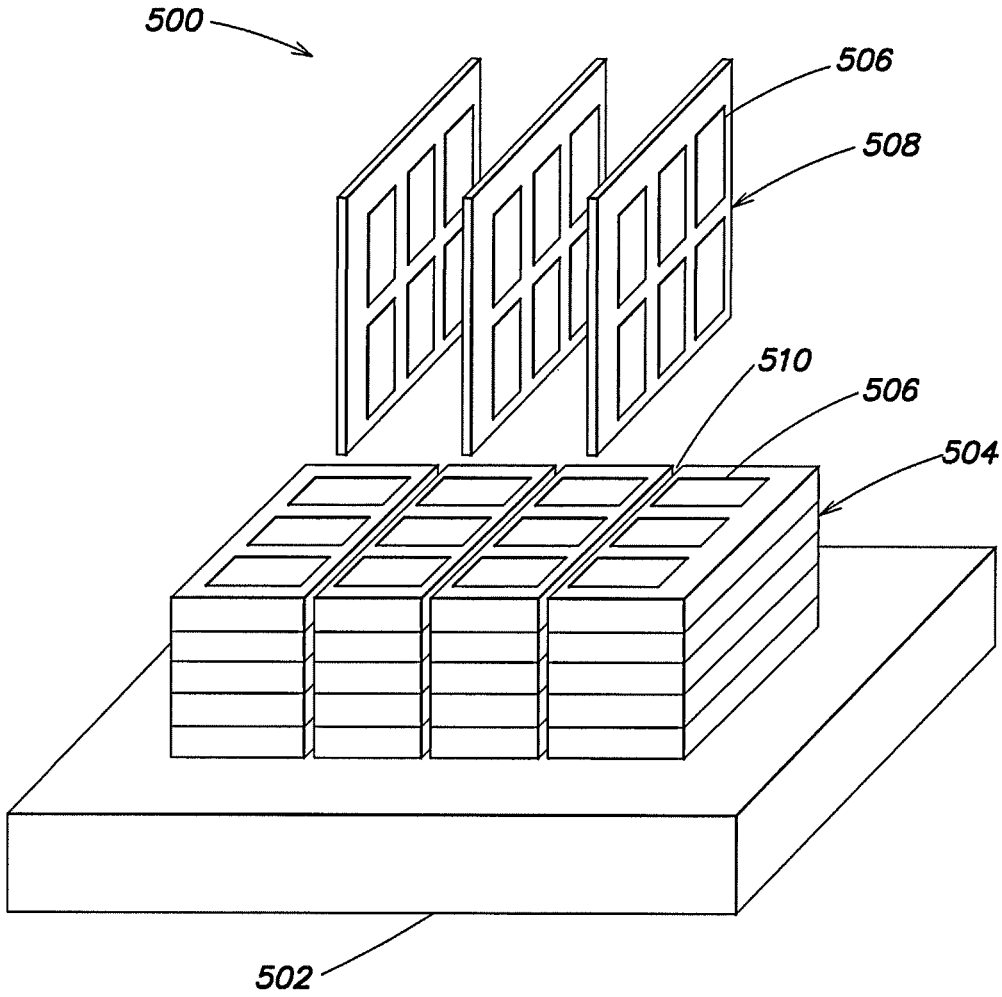
FIG. 5 illustrates an example of a manner of fabrication of a polarizer comprising a meta-material, according to a non-limiting embodiment.

According to an aspect of the present application, polarizers of the type illustrated by polarizer 200 of FIG. 2 may be formed in any suitable manner. FIG. 5 illustrates a non-limiting example of a manner in which a suitable meta-material may be formed, for use in a polarizer of the type illustrated in FIG. 2. As shown, the apparatus 500 may include a working base 502 on which multiple printed circuit board layers 504 may be stacked. FIG. 5 illustrates five printed circuit boards stacked on the working base, though it should be appreciated that any suitable number may be included. Each of the printed circuit boards 504 may include a plurality of circuit components 506 formed thereon. The circuit components 506 may be any of the types previously described herein (e.g., with respect to FIGS. 3A-3F) or any other suitable type.

As mentioned with respect to FIG. 2, according to a non-limiting embodiment a meta-material for use as a polarizer may include circuit components oriented at an angle $\alpha$ with respect to each other, such as 90°. Accordingly, as shown in FIG. 5 such a meta-material may be formed in a non-limiting embodiment by inserting printed circuit boards 508 into slots 510 in the stack of printed circuit board layers 504. The slots 510 may have any suitable thickness, for example being approximately 5 mil in some non-limiting embodiments. The printed circuit boards 508 may substantially form a right angle with the base 502, and therefore the circuit components 506 on printed circuit boards 508 may be oriented substantially orthogonally to the circuit components 506 on printed circuit boards 504. The printed circuit boards 508 may be fastened relative to the printed circuit boards 504 in any suitable manner, for example using an adhesive, a pressure fit into the slots 510, or in any other suitable manner.

FIGS. 6-9 illustrate alternative non-limiting embodiments of meta-materials which may be used to form part or all of a polarizer of the type represented by polarizer 200 in FIG. 2.

Figure 6:
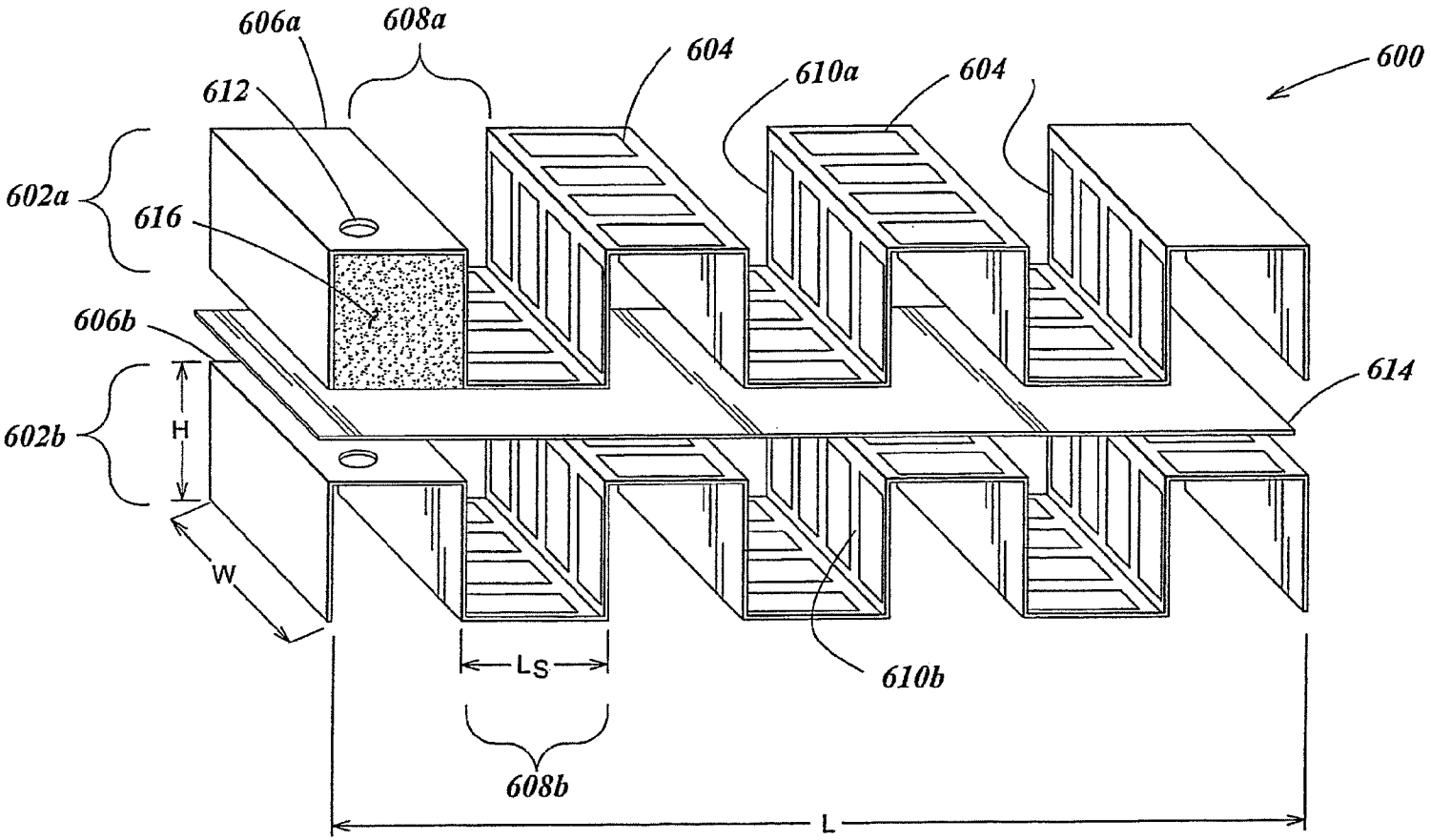
FIG. 6 illustrates a non-limiting example of a meta-material which may be used as at least part of a polarizer of an antenna element, according to a non-limiting embodiment.

Referring to FIG. 6, the electromagnetic meta-material 600 comprises multiple corrugated substrates 602*a* and 602*b*. For purposes of simplicity, only two corrugated substrates are illustrated. However, it should be appreciated that electromagnetic meta-materials according to the present aspect may, and in some scenarios will, include more than two corrugated substrates. For instance, tens, hundreds, thousands, or any suitable number of substrates may be used to form a meta-material of desired dimensions. As shown, each of the corrugated substrates 602*a* and 602*b* may include circuit components 604 (e.g., of the types previously described herein with respect to FIGS. 3A-3F). In the non-limiting embodiment of FIG. 6, each of the corrugated substrates 602*a* and 602*b* includes four circuit components 604 on each corrugated segment, positioned across the illustrated width W.

The substrates 602*a* and 602*b* may be formed of any suitable material. For example, in one non-limiting embodiment, the substrates 602*a* and 602*b* are formed of printed circuit boards (PCBS). The material may, in some embodiments, be selected to provide a desired electromagnetic property (e.g., a desired dielectric constant). For instance, according to one non-limiting embodiment, the substrates 602*a* and 602*b* are formed of a low dielectric constant material. In some embodiments, the substrates 602*a* and 602*b* may be formed of a material that is substantially flexible, which may facilitate formation of the corrugated structures illustrated in FIG. 6. However, it should be appreciated that any suitable type of material may be used for the substrates 602*a* and 602*b*, and that the various aspects of the present application are not limited to using any particular type of material as a substrate material, unless otherwise stated.

The corrugated substrates 602*a* and 602*b* may have any suitable dimensions, including any suitable length L, any suitable width W, and any suitable height H. According to one non-limiting embodiment, the width W may take any suitable value between approximately two inches and twenty inches (e.g., approximately five inches, approximately ten inches, etc.), between approximately 6 and 18 inches (e.g., 6 inches, 8 inches, 10 inches, 12 inches, etc.), between approximately 1 and 6 inches (e.g., 2 inches, 3 inches, etc.), less than approximately 3 inches, or may take any other suitable value. Similarly, the height H of corrugated substrates 602*a* and 602*b* may fall within a range from approximately 0.1 to one inches (e.g., 0.25 inches), between approximately 0.5 inches and 2 inches, less than 3 inches, or may take any other suitable values, as non-limiting examples. The length L may also assume any suitable value, for example ranging between 2 and 20 inches (e.g., 5 inches, 10 inches, 15 inches, or any other suitable value), as a non-limiting example. The length L may be greater than the width W. In some non-limiting embodiments, the length of the corrugated substrate may be substantially greater than the width of the substrates. In some such embodiments, the substrates may be referred to as corrugated ribbons or corrugated strips, though it should be appreciated that other terminology may also be used to refer such structures.

The corrugated substrates 602*a* and 602*b* may include any suitable number of corrugations, and therefore any suitable number of corrugated segments. The segments may have any suitable length $L_S$. For example, the length $L_S$ may fall within a range from approximately 0.1 inches to approximately 1 inch (e.g., ¼ inch), from approximately 0.5 inches to approximately 2 inches, less than 2 inches, less than 1 inch (e.g., ¼ inch, ½ inch, etc.), or may take any suitable value. Furthermore, not all segments need have the same length. For example, peak and trough segments may differ in length from each other. Alternatively, or in addition, the length of vertical segments (e.g., segments perpendicular to the adhesive layer 614, described further below) may differ in length from the length of peak segments and/or trough segments. Thus, the present aspect is not limited to substrates having any particular number or dimensions of corrugated segments. Therefore, it should be appreciated that the number of corrugations illustrated in FIG. 6 is non-limiting, as other numbers are possible.

Referring again to FIG. 6, it should be appreciated that any number of circuit components 604 may be included, and that substrates 602*a* and 602*b* need not include an identical number of circuit components. Furthermore, each segment of the corrugated substrates 602*a* and 602*b* need not include the same number of circuit components, or any circuit components at all. For example, according to an alternative embodiment to that illustrated in FIG. 6, circuit components may only be included on the peak segments 606*a* and 606*b* of the corrugated substrates. According to an alternative embodiment, circuit components 604 may only be included on the trough segments 608*a* and 608*b* of the corrugated substrates. Alternatively, circuit components may only be included on the vertical wall segments 610*a* and 610*b* of the substrates 602*a* and 602*b*. Any combination of the segments of substrates 602*a* and 602*b* may include circuit components formed thereon in any suitable manner (as discussed further below).

As also illustrated in FIG. 6, in some non-limiting embodiments of the present aspect, the corrugated substrates 602*a* and 602*b* may be substantially aligned with each other. For example, the substrates 602*a* and 602*b* may be substantially aligned such that peak segments of the two substrates substantially align with each other and trough segments of the two substrates substantially align with each other. For instance, as illustrated in FIG. 6, peak segment 606*a* of corrugated substrate 602*a* substantially aligns with peak segment 606*b* of corrugated substrate 602*b*. Similarly, trough segment 608*a* of corrugated substrate 602*a* substantially aligns with trough segment 608*b* of corrugated substrate 602*b*. Moreover, wall segment 610*a* of corrugated substrate 602*a* substantially aligns with wall segment 610*b* of corrugated substrate 602*b*. The illustrated alignment is one non-limiting example of suitable alignment, as other alignment configurations may also be implemented.

As will be described further below with respect to FIG. 2, alignment of the corrugated substrates 602*a* and 602*b* may be facilitated by alignment features on one or more the substrates. For example, alignment holes 612 may be included to facilitate alignment of the substrates.

The electromagnetic meta-material of FIG. 6 may, optionally, further include a structure for maintaining the substrates in a desired alignment or configuration with respect to each other. For example, an optional adhesive layer 614 may be included. The optional adhesive layer 614 may be included to facilitate maintaining the fixed alignment between the corrugated substrates 602*a* and 602*b*. For example, each of corrugated substrates 602*a* and 602*b* may be fixedly adhered to a respective surface of the adhesive layer 614. In this manner, positioning of the corrugated substrates with respect to each other may be maintained. The shape of the corrugated substrates may also be maintained at least in part by the adhesive layer.

In those embodiments in which an adhesive layer 614 is included, the adhesive layer may be formed of any suitable material. For example, the adhesive layer 614 may comprise polyamide, a liquid crystal polymer, a plastic, or any other suitable material. In some embodiments, the adhesive layer may be formed of a material providing a desired electromagnetic property, such as a desired dielectric constant. For example, a material of low dielectric constant may be used as the adhesive layer 614. Thus, it should be appreciated that in those embodiments in which an adhesive layer is included, the adhesive layer is not limited to being formed of any particular material.

In some embodiments, an optional filler material may be included in the meta-material 600. The filler may be included to provide desired electromagnetic behavior (e.g., to tune the meta-material), may be provided to support the substrates (e.g., to maintain their shape), or may be provided for any other reason. As a non-limiting example, optional filler material 616 may be disposed between at least part of the corrugated substrate 602*a* and part of the corrugated substrate 602*b*. As illustrated, in this non-limiting example, the optional filler material may be disposed under a peak segment 606*a* of corrugated substrate 602*a*, for example between the corrugated substrate 602*a* and the adhesive layer 614. The filler material may be included for any suitable reason, for example to tune the frequency operation of the electromagnetic meta-material, to provide support for the corrugated substrate 602*a*, or for any other suitable reason.

The optional filler material may be any suitable material for providing the desired function (e.g., a supporting function, a frequency tuning function, etc.). According to some embodiments, the filler material 616 may be formed of a low dielectric constant material. The material may be chosen to have a dielectric constant which may be used to tune the frequency behavior of the electromagnetic meta-material (e.g., to tune the resonance frequency of the meta-material, or otherwise). The filler material may be foam (e.g., syntactic foam) in some non-limiting embodiments. According to some embodiments, the filler material 616 may have a dielectric constant that varies with position. For example, the filler material 616 may have a graded dielectric constant.

It should be appreciated that in the illustrated configuration, circuit components 604 on the peaks and troughs of the corrugated substrates 602*a* and 602*b* may be formed at angles relative to each other. For example, the wall segments 610*a* and 610*b* may be at an angle α, as used in FIG. 2, relative to the peak and trough segments. Thus, the use of corrugated substrates, such as illustrated in FIG. 6, represent a non-limiting example of a manner in which to achieve the angle α of FIG. 2, and the peak and trough segments of FIG. 6 may correspond to the segments 202 of FIG. 2, while the wall segments of FIG. 6 may correspond to segments 204 of FIG. 2, as a non-limiting example.

According to another non-limiting aspect of the present application, an electromagnetic meta-material comprises a slab of a first material in which are disposed distinct substrates on which one or more circuit components are formed. The substrates may be disposed within the slab of material (e.g., encased within the slab, embedded within the slab, or otherwise disposed at least partially within the slab) in an array of any suitable orientation. For example, substrates may be disposed at substantially 90° with respect to each other. A non-limiting example illustrated in FIG. 7.

Figure 7:
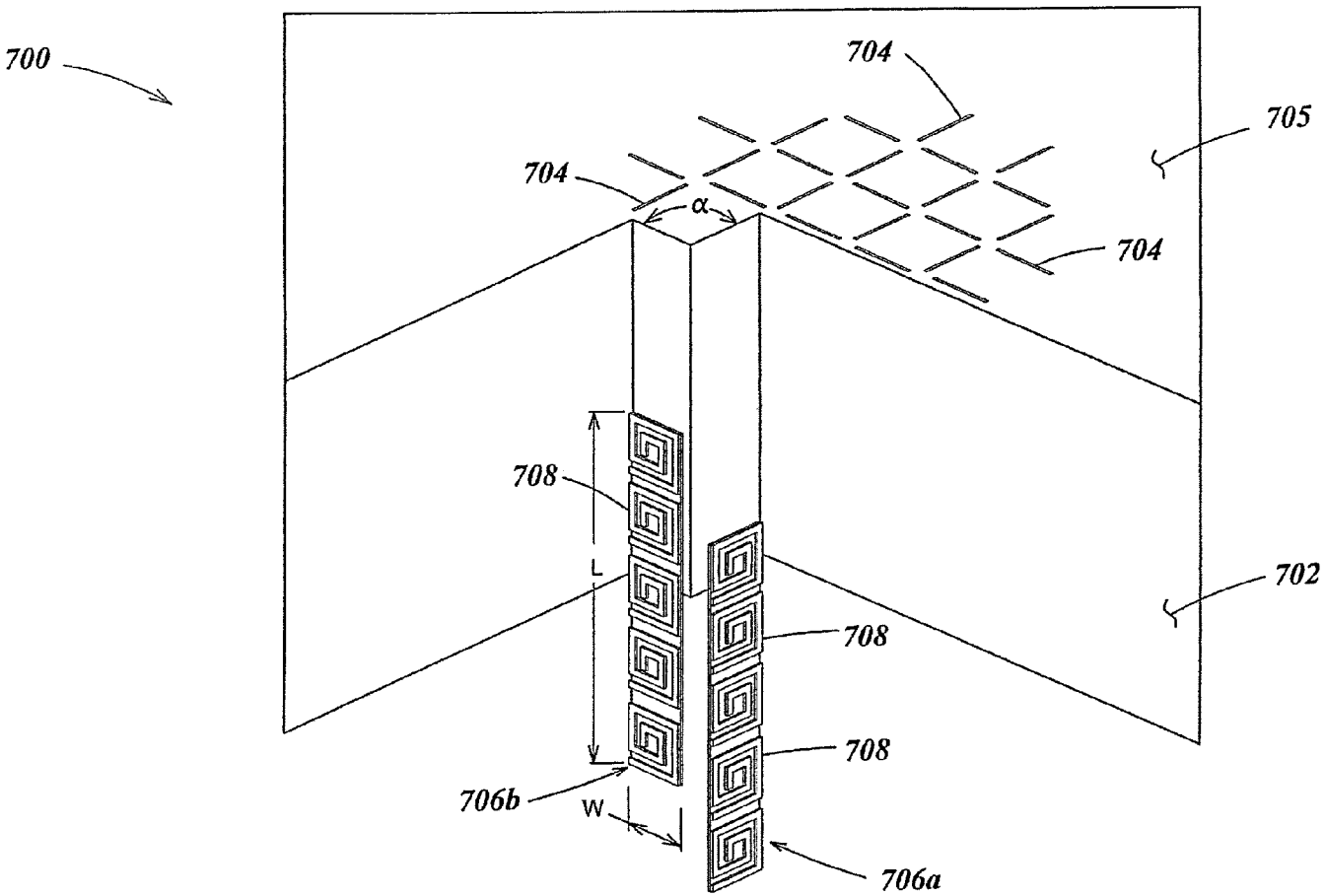
FIG. 7 illustrates a non-limiting example of a meta-material according to an alternative embodiment, and which may be used as at least part of a polarizer of an antenna element.

As shown, the electromagnetic meta-material 700 includes a slab 702 (FIG. 7 illustrates a cut-away view of the slab) of first material, in which slits 704 are formed. It should be appreciated that the terminology used herein is not limiting, and that various terms may be used to describe the illustrated structures. For example, slab 702 may alternatively be referred to as a "block" of material or a "body" of material, as non-limiting examples. Similarly, the slits 704 may alternatively be referred to as "slots," as a non-limiting example. Thus, the slab 702 may be referred to in some embodiments as a slotted dielectric slab. Also, it should be appreciated that the slits in some embodiments may more generally be openings, not necessarily having a slit structure.

As shown, a plurality of substrates may be disposed within respective slits 704 in the slab 702. In some non-limiting embodiments, the substrates may have a relatively small width W compared to the length L, and therefore may be referred to as substrate strips for purposes of explanation. The present embodiment assumes such a configuration, with FIG. 7 illustrating substrate strips 706*a* and 706*b*. The substrate strips may be disposed within slits oriented substantially at an angle α (e.g., a right angle) with respect to each other. The angle α may be the same angle as that shown in FIG. 2. However, it should be appreciated that other angles of orientation may also be implemented.

The slab 702 may be formed of any suitable material. According to a non-limiting embodiment, the slab of material may comprise a syntactic foam. In some non-limiting embodiments, the slab of material may be formed of a material providing a desired dielectric constant. For example, given that the slab of material may effectively fill spaces between substrate strips 706*a* and 706*b*, the material may be used to tune the electromagnetic properties of the electromagnetic meta-material 700, e.g., the material of slab 702 may help control the resonance frequency of the meta-material 700. Accordingly, the material forming slab 702 may be selected to have any suitable dielectric constant.

The slits 704 may have any suitable dimensions. According to a non-limiting embodiment, slits 704 may be sufficiently sized to accommodate substrate strips 706*a* and 706*b*. For example, the slit 704 may be of substantial size to allow insertion of the strips into the slab 702, but may be suitably sized to maintain a sufficient pressure fit of the substrate strips, to maintain the substrate strips in a substantially fixed position. For example, the slits may have a dimension slightly less than the width W. In a non-limiting example, the substrate strips may have a width W of approximately 1 inch, such that each of the slits 704 may similarly have a width of approximately, but slightly less than, 1 inch. Alternative dimensions are possible.

Any suitable number of slits 704 may be provided in the slab 702 of material. According to a non-limiting embodiment, one slit per substrate strip may be provided. Alternative configurations are possible.

The substrate strips 706*a* and 706*b* may be similar to corrugated substrates 602*a* and 602*b*, but without the corrugations (e.g., the substrate strips 706*a* and 706*b* may be substantially planar). The substrate strips 706*a* and 706*b* may be formed of any suitable material, may include any suitable dimensions, and may include any suitable type and number of circuit components formed thereon. For example, the substrate strips may have any of the features previously described with respect to substrates 602*a* and 602*b*. As a non-limiting example, each of substrate strips 706*a* and 706*b* includes five spiral loop resonators 708, as shown. However, alternative numbers and shapes are possible.

Again, it should be appreciated that the meta-material 700 represents a non-limiting example of a meta-material which may be used to form at least part of a polarizer of an antenna element, such as polarizer 200 of FIG. 2. Alternatives are possible.

According to another non-limiting aspect of the present application, an electromagnetic meta-material may be formed, at least in part, by interconnecting two or more substrates to form an array of circuit components. In some non-limiting embodiments, spaces between the substrates may be filled with a core material (or filler material), though in other embodiments any spaces between the substrates may be left as air gaps. A non-limiting example is illustrated in FIG. 8.

As shown, the electromagnetic meta-material 800 includes a plurality of substrates 802 which are interconnected with each other. Each of the substrates may have one or more circuit components 804 formed thereon. The substrates 802 may be interconnected to form a two dimensional (single layer) array, as illustrated in FIG. 8, or to form a three dimensional (multi-layer) array, as illustrated in FIG. 9 and described further below.

Figure 8:
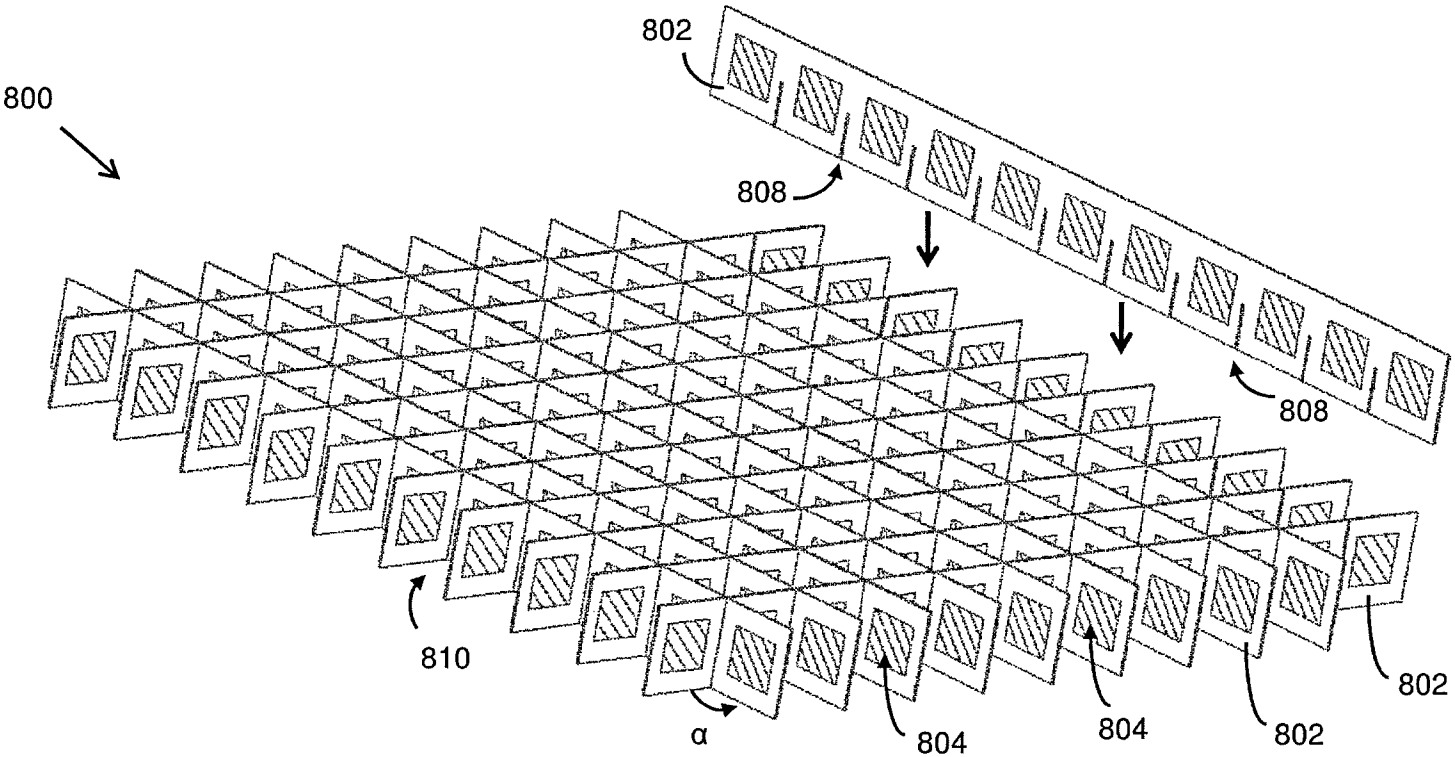
FIGS. 8 and 9 illustrate single layer and multi-layer configurations, respectively, of a metal-material according to an alternative embodiment, and which may be used as at least part of a polarizer of an antenna.
Figure 9:
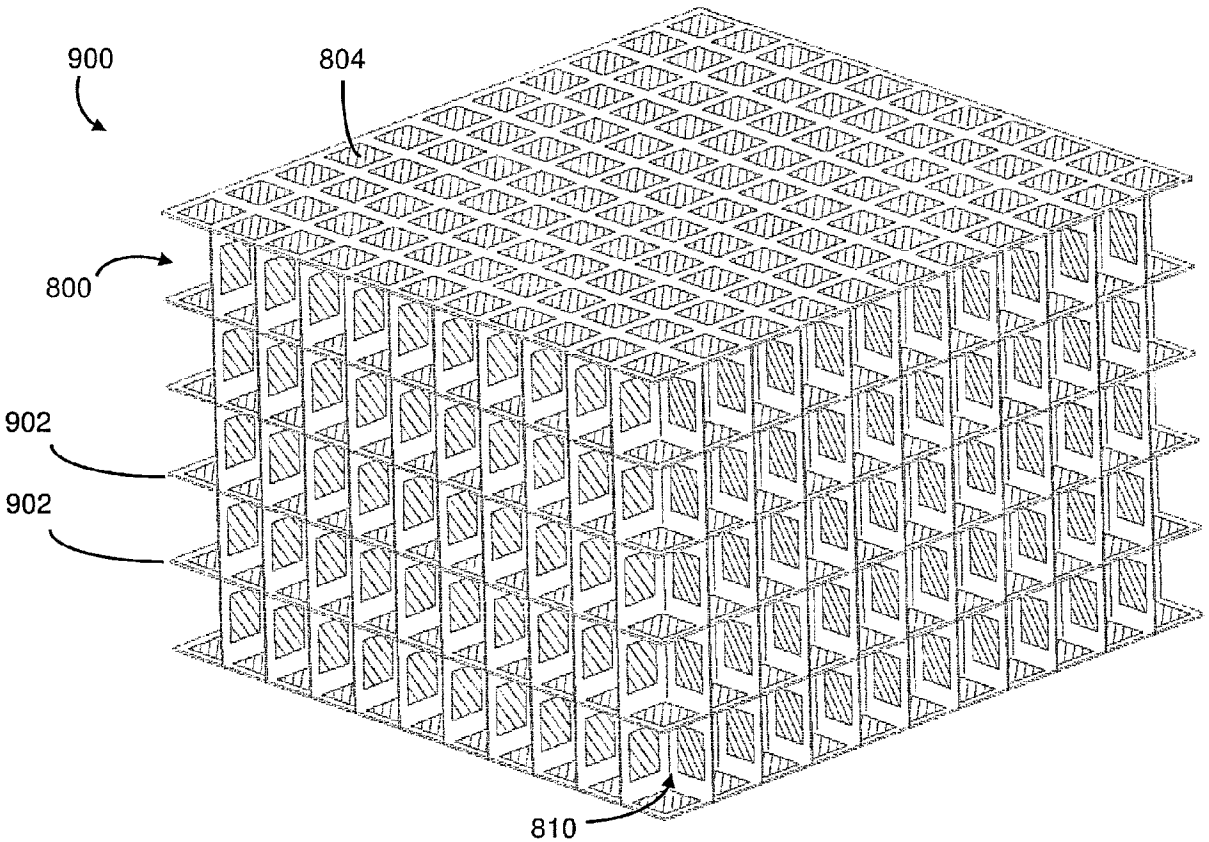

The substrates 802 in FIG. 8 may be any suitable substrate on which circuit components 804 may be formed. According to a non-limiting embodiment, the substrates 802 may be any of the types of substrates previously described with respect to the figures of the present application. For example, substrates 802 may be the same as previously described substrate strips 706*a*, though this is a non-limiting example. Thus, as a non-limiting example, each of substrates 802 may be formed of a printed circuit board having a desired dielectric constant.

The substrates 802 may be interconnected in any suitable manner. As illustrated in FIG. 8, each substrate 802 may include slits (or slots) or notches 808 which may accommodate another one of the substrates 802. For example, a substrate 802 having a slit 808 formed along a particular side of the substrate may be slid down over other substrates 802 of the electromagnetic meta-material, as illustrated by the arrows in FIG. 8. In this manner, an array of interconnected substrates may be formed. As illustrated, connection of the substrates 802 may effectively form distinct unit cells 810 in which circuit components 804 are physically separated from other circuit components of the illustrated meta-material. The angle of intersection $\alpha$ between the substrates may take any suitable value, and according to a non-limiting embodiment is approximately 90°. However, other angles may be used.

It should be appreciated from the foregoing that the interconnection of substrates in the manner illustrated in FIG. 8 may allow the formation of a regular, repeating pattern of circuit components 804, for example suitable for use as a polarizer 200 of FIG. 2. Thus, a desired pattern may be formed using suitable slits and substrates.

The circuit components 804 may be of any suitable type, and of any suitable number. For example, circuit components 804 may be any of those types previously described herein. According to a non-limiting embodiment, each of circuit components 804 may comprise a split ring resonator. However, other circuit components and/or circuits may alternatively be implemented. Furthermore, each unit cell 810 need not include its own circuit component, as, for example, circuit components may only be included on a subset of the substrates 802 or only on certain portions of a substrate 802. Thus, it should be appreciated that the aspect of the present application relating to interconnection of substrates to form a grid pattern of circuit components 804 at a desired angle of intersection relative to each other is not limited to the number of circuit components, the type of circuit components, or any particular configuration of circuit components.

Optionally, interconnection of the substrates 802 may be facilitated by a fastening mechanism, for example to ensure rigidity of the interconnection and thus assist in the electromagnetic meta-material 800 maintaining a desired shape. For example, an adhesive (e.g., glue) may be placed at some or all of the intersection points of the substrates 802.

Optionally, the spaces between the substrates 802 may be filled with a filler material. As a non-limiting example, a syntactic foam may be disposed within at least some of the illustrated gaps. Not all illustrated gaps need be filled with foam, and in some embodiments, foam is not inserted in any of the gaps If a filler material is used, any suitable material may be used, such as any of those previously described herein.

FIG. 9 illustrates an extension of the technology illustrated in FIG. 8 to provide a three dimensional, multi-layer electromagnetic meta-material structure. As shown, the electromagnetic meta-material 900 includes a plurality of structures of the type illustrated in FIG. 8, i.e., a combination of a plurality of structures 800. These may be stacked relative to each other, with a sheet 902 between neighboring structures 800. Each of the sheets 902 may itself optionally include a plurality of circuit components 804 of the type previously described with respect to FIG. 8, or any other suitable type of circuit component. As shown, the circuit components 804 on the sheet 902 may be arranged in any suitable manner, for example, such that a single circuit component 804 of the sheet 902 corresponds to each unit cell 810.

The sheets 902 may be formed of any suitable material, and in some embodiments may be of the same material as that used for substrates 802. For example, each of sheets 902 may comprise a printed circuit board on which the circuit component 804 may be formed in any suitable manner.

It should be appreciated that the angle which sheet 902 makes relative to the electromagnetic meta-material 800 may be any suitable angle, such as a right angle, or any other suitable angle. Accordingly, in a non-limiting embodiment, each unit cell 810 may be substantially shaped as a cube. However, other configurations are possible, as this non-limiting example is provided merely for purposes of illustration.

The sheets 902 may be bonded relative to the electromagnetic meta-material layer 800 in any suitable manner. For example, an adhesive (e.g., glue) may be used.

As with the electromagnetic meta-material 800 of FIG. 8, the unit cells 810 in FIG. 9 may be filled with a filler material, such a syntactic foam or any other suitable type of filler material. However, the use of such filler material in the configuration of FIG. 9 is optional, as not all embodiments include such a filler material.

The meta-material illustrated in FIG. 9 may be used to form at least part of a polarizer of an antenna element according to an aspect of the present application. For example, the meta-material 900 may be used to form at least part of polarizer 200 of FIG. 2.

Figure 10:
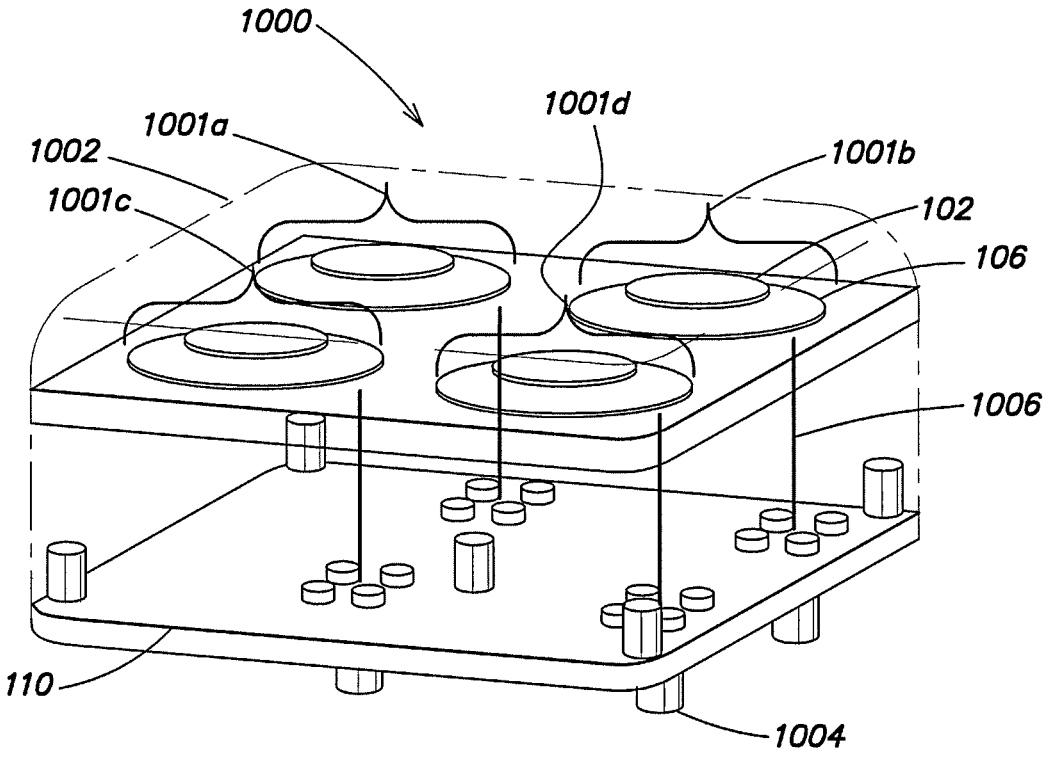
FIG. 10 illustrates a non-limiting example of an antenna comprising multiple elements, each including a patch and a polarizer comprising a meta-material, according to a non-limiting embodiment.

FIG. 10 illustrates a non-limiting example of an antenna including multiple antenna elements of the types previously described herein (e.g., with respect to FIG. 1), and further including a radome. The illustrated antenna may be suitable for use as a GPS antenna, may operate as a dual-band antenna, and may be resistant to jamming from jamming signals originating from three or fewer locations, as a non-limiting example.

As shown, antenna 1000 may include a radome 1002 enclosing a plurality of antenna elements 1001*a*-1001*d*. Each of the plurality of antenna elements 1001*a*-1001*d* may be of the type previously illustrated and described with respect to FIG. 1. For example, each of the four illustrated antenna elements may include patches 102 and 106, as previously described with respect to FIG. 1, as well as corresponding polarizers (e.g., polarizers 104 and 108). Thus, each of the four illustrated antenna elements may be suitable for dual-band operation, capable of receiving signals at two different frequencies (e.g., the L1 and L2 frequencies).

As shown, the radome 1002 may substantially encompass the antenna elements, and in some embodiments may also encompass the ground plane 110, previously described with respect to FIG. 1. The radome may be formed of any suitable material, and may have any suitable shape. The substantially square shape illustrated in FIG. 10 is a non-limiting example.

Each of the antenna elements may be accessed via a single respective electrical connector 1004. For example, the electrical connectors 1004 may be SMA RF connectors or any other suitable connectors. Probes 1006 may run from a respective connector 1004 to the respective patches 102 and 106. However, it should be appreciated that other manners of accessing the antenna elements are also possible.

The antenna 1000 may have any suitable dimensions, and in some embodiments may be substantially smaller than four element antennae not using the patch and polarizer configuration according to various aspects of the present application. For example, the antenna 1000 may have a long dimensions of less than approximately thirteen inches, or may have any other suitable size. Thus, according to an aspect of the present application, a compact, dual-band GPS antenna may be provided, which may be resistant to jamming signals originating from multiple locations.

Figure 11:
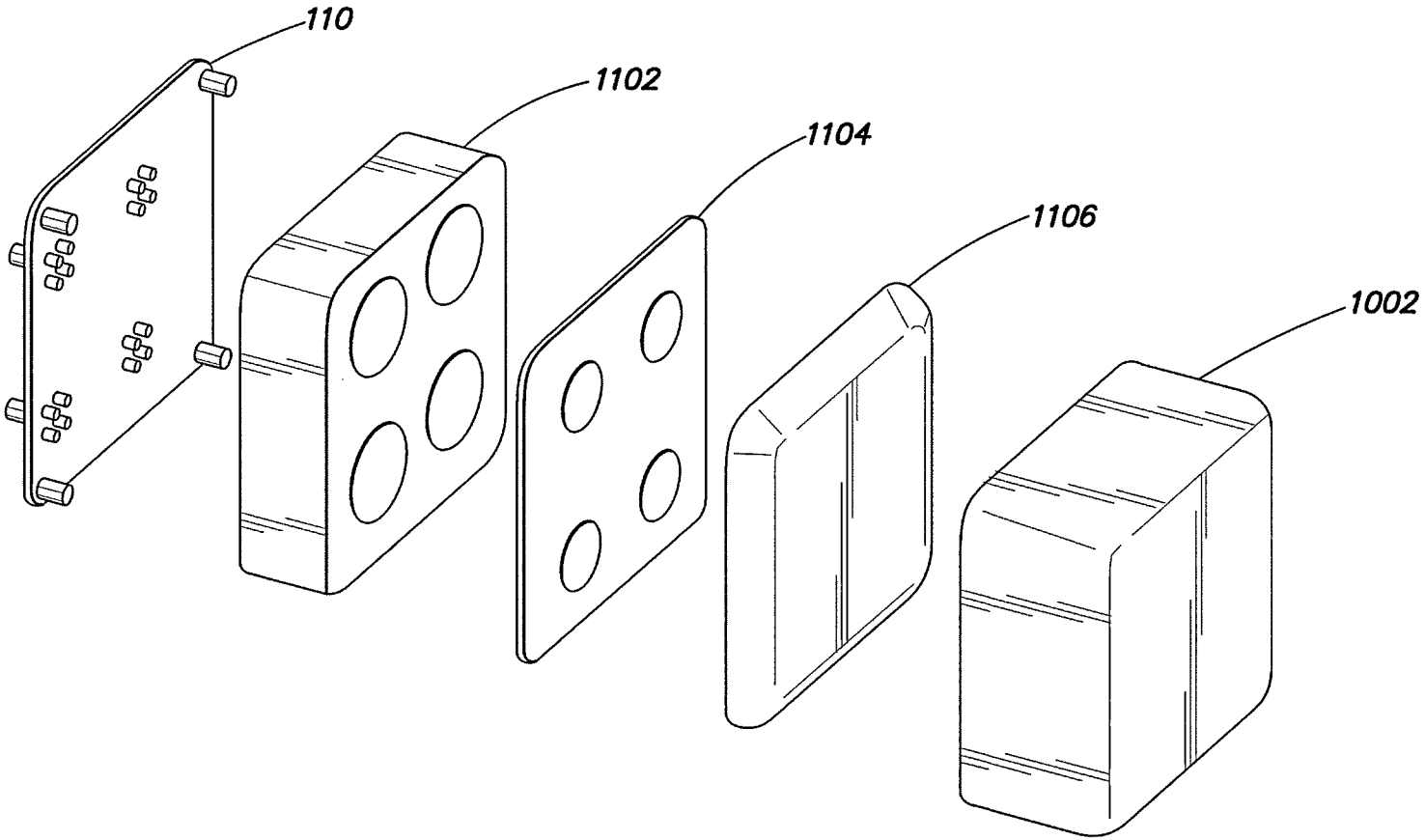
FIG. 11 illustrates an exploded view of the antenna of FIG. 10, according to a non-limiting embodiment.

FIG. 11 illustrates the antenna 1000 of FIG. 10 in exploded view. As shown, the antenna 1000 may include the electrical ground plane 110, including openings for providing electrical access to the antenna elements. A first layer 1102 may include a first set of patches and polarizers, for example configured to operate a first frequency. For example, the first layer 1102 may include four patches and four respective polarizers, each pair of which may be configured to operate on signals of a first frequency, for example, the L2 frequency. The layer 1104 may include four patches and four corresponding polarizers, each pair of which may be configured to operate on signals of a different frequency that the patch-polarizer pairs on layer 1102, for example, the L1 frequency. These frequencies are non-limiting examples, however, as it should be appreciated that the antenna described herein are not limited to use with any particular frequencies unless otherwise stated.

A support layer 1106 may be included to ensure stable fit of the antenna components within the radome 1002. However, such a support layer is optional. The support layer 1106 may be formed of foam, or any other suitable material.

FIG. 11 illustrates a non-limiting example of a manner in which to form the components of antenna 1000 of FIG. 10. Other implementations are possible.

Various benefits may be realized by application of one or more aspects described herein. It should be appreciated, however, that not all aspects necessarily provide each benefit, and that various additional benefits may be provided, as those mentioned are non-limiting examples. GPS antenna may be made according to one or more aspects of the present application, and may have a relatively small size compared to conventional GPS antennae. In addition, GPS antenna may be formed with multiple antenna elements, as described herein, and therefore may resist jamming from multiple locations. Antennae described herein may operate as dual band antennae, as previously described. For example, a GPS antenna suitable for operation at both L1 and L2 frequencies may be provided according to one or more aspects of the present application. In addition, the antennae described herein may provide a relatively large bandwidth, for example, greater than 10 megahertz, greater than 20 megahertz, between approximately 10 and 25 megahertz, or any other suitable bandwidth. According to one embodiment, a meta-material GPS antenna in accordance with an aspect of the invention may provide approximately 4× (four times) size reduction to achieve null steering for anti-jam function. Other benefits may also be realized.

Having thus described several aspects of at least one embodiment of the technology, it is to be appreciated that various alterations, modifications, and improvements will readily occur to those skilled in the art. Such alterations, modifications, and improvements are intended to be within the spirit and scope of the technology. Accordingly, the foregoing description and drawings provide non-limiting examples only.

What is claimed is:

1. An antenna, comprising:

a plurality of circular conductive patches;

an electrical ground plane; and a plurality of meta-material elements, wherein the plurality of meta-material elements and the plurality of circular conductive patches are paired together such that, for each circular conductive patch of the plurality of circular conductive patches, a respective meta-material element is disposed between the circular conductive patch and the electrical ground plane, wherein at least one of the meta-material elements comprises a first plurality of substantially planar conductive loops and a second plurality of substantially planar conductive loops, wherein each substantially planar conductive loop of the first and second pluralities of substantially planar conductive loops is substantially perpendicular to the circular patch, and wherein each substantially planar conductive loop of the first plurality of substantially planar conductive loops is substantially perpendicular to each substantially planar conductive loop of the second plurality of substantially planar conductive loops.

2. The antenna of claim 1, wherein the plurality of circular conductive patches comprises four circular conductive patches and wherein the plurality of meta-material elements comprises four meta-material elements.

3. The antenna of claim 1, wherein each of the circular conductive patches has a greater diameter than a diameter of a respective one of the plurality of meta-material elements.

4. An antenna, comprising:

a patch; and a meta-material configured to be electromagnetically coupled to the patch, the meta-material having an array of a first plurality of substantially planar conductive elements and a second plurality of substantially planar conductive elements, wherein a first substantially planar conductive element of the first plurality of substantially planar conductive elements and a second substantially planar conductive element of the second plurality of substantially planar conductive elements is oriented substantially perpendicularly to the patch, and wherein the first substantially planar conductive element is substantially perpendicular to the second substantially planar conductive element.

5. The antenna of claim 4, wherein the patch is a circular patch.

6. The antenna of claim 4, further comprising a ground plane, wherein the meta-material is disposed between the ground plane and the patch.

7. The antenna of claim 4, wherein the patch and the meta-material in combination form a single receiving element of the antenna, and wherein the antenna comprises at least three receiving elements.

8. The antenna of claim 4, wherein each of the first and second substantially planar conductive elements is a spiral loop.

9. The antenna of claim 4, wherein each of the first and second substantially planar conductive elements is a split ring resonator.

10. The antenna of claim 4, wherein the patch is a circular patch having a diameter, and wherein the meta-material has a diameter smaller than the diameter of the patch.

11. A dual-band antenna, comprising:

a first patch;

a first polarizer;

a second patch; and a second polarizer, wherein, between an output of the antenna and an electrical ground plane of the antenna, the first patch, the first polarizer, the second patch, and the second polarizer are disposed in that order.

12. The dual-band antenna of claim 11, wherein the first polarizer comprises a meta-material configured to operate as a circular polarizer.

13. The dual-band antenna of claim 11, wherein the first patch and the first polarizer in combination are configured to receive signals at a first frequency and wherein the second patch and the second polarizer in combination are configured to receive signals at a second frequency different than the first frequency.

14. The dual-band antenna of claim 13, wherein the first frequency is substantially equal to a L1 global positioning system (GPS) frequency and wherein the second frequency is substantially equal to a L2 GPS frequency.

15. The dual-band antenna of claim 11, wherein each of the first and second patches is a circular patch.

16. The dual-band antenna of claim 11, wherein the first polarizer comprises a meta-material exhibiting a negative magnetic permeability.

17. The dual-band antenna of claim 16, wherein the meta-material comprises a plurality of conductive elements, wherein at least one of the plurality of the conductive elements is perpendicular to another one of the plurality of conductive elements.

18. The dual-band antenna of claim 17, wherein each conductive element of the plurality of conductive elements comprises a spiral loop.

19. The dual-band antenna of claim 11, further comprising a radome in which the first patch, the first polarizer, the second patch, and the second polarizer are disposed.

* * * * *